US005277783A

United States Patent [19]

Ohashi et al.

[11] Patent Number: 5,277,783

[45] Date of Patent: Jan. 11, 1994

[54] MANUFACTURING METHOD FOR ORIFICE PLATE

[75] Inventors: Yumiko Ohashi, Hashima; Hideo Maruyama, Kuwana, both of Japan

[73] Assignee: Brother Kogyo Kabushiki Kaisha, Nagoya, Japan

[21] Appl. No.: 874,009

[22] Filed: Apr. 27, 1992

[30] Foreign Application Priority Data

May 15, 1991 [JP] Japan ..... 3-110582
May 15, 1991 [JP] Japan ..... 3-110583
Jul. 26, 1991 [JP] Japan ..... 3-187862

[51] Int. Cl.[5] ..... C25D 1/08
[52] U.S. Cl. ..... 205/75
[58] Field of Search ..... 205/75

[56] References Cited

U.S. PATENT DOCUMENTS 3,878,061 4/1975 Feldstein ..... 205/75

OTHER PUBLICATIONS

Sumio Sakka, "Sol-Gel Synthesis of Glasses: Present and Future", 1985, American Ceramic Bulletin, vol. 64, No. 11, pp. 1463-1466.

*Primary Examiner*—T. M. Tufariello
*Attorney, Agent, or Firm*—Oliff & Berridge

[57] ABSTRACT

The present invention relates to a manufacturing method for an orifice plate to be used for an ink jet printer or the like. First, a master having a predetermined pattern firmly provided on a substrate is prepared. An electroformed film is then formed on the master by an electroforming method. Finally, the electroformed film is separated from the substrate. In this case, the mask pattern is firmly provided on the substrate, and a mechanical strength of the mask pattern itself is large. Furthermore, the mask pattern is insoluble to an alkali aqueous solution. Thus, the master can be reused, and it can be strongly washed. Accordingly, the master has a durability to repeated usage, thereby contributing to an improvement in the quality of the orifice plate to be manufactured and a reduction in the manufacturing cost.

12 Claims, 5 Drawing Sheets

MANUFACTURING METHOD FOR ORIFICE PLATE

BACKGROUND OF THE INVENTION

1. Field of the Invention

The present invention relates to a manufacturing method for an orifice plate which forms an ink discharging portion of an ink jet printer.

2. Description of the Related Art

As a manufacturing method for an orifice plate which forms an ink discharging portion of an ink jet printer, the following method is conventionally known. In such a conventional manufacturing method, a photoresist having a nonconductive characteristic is first provided on a substrate having a conductive characteristic in accordance with a predetermined pattern, thereby preparing a master. An electroformed film made of nickel, which will later become an orifice plate, is then formed on the master by a known electroforming method. Finally, the electroformed film is separated from the master to thereby obtain the orifice plate.

An example of the conventional manufacturing method for the orifice plate will now be described with reference to FIGS. 5A to 5D. FIGS. 5A to 5D illustrate the exemplary conventional manufacturing method for the orifice plate in chronological order.

First, a photoresist 2 of a positive type is uniformly applied onto a conductive substrate 1 by a known spin coating method. As an example of the positive type photoresist 2, naphtho-quinone-diazide is known. The naphtho-quinone-diazide has an alkali insoluble characteristic. After dropping 2–3 cc of the naphtho-quinone-diazide on the conductive substrate 1, the conductive substrate 1 is retained by a spin coater and is rotated at 5000 rpm for 20 seconds. As a result, the photoresist 2 is uniformly coated on the conductive substrate 1. Thereafter, the conductive substrate 1 on which the photoresist 2 is coated is prebaked in a clean oven at about 90° C. for about 30 minutes. As a result, the positive type photoresist 2 having a thickness of about 1 μm (micrometer) is formed on the conductive substrate 1. Thereafter, a photomask 3 having a light shielding portion 3A with a predetermined pattern is placed on an upper surface of the photoresist 2. The photomask 3 is a thin sheet or a thin plate having a characteristic of transmitting at least an ultraviolet light, so that light is permitted to penetrate only a light transmitting portion of the photomask 3, not the light shielding portion 3A. The light shielding portion 3A is constituted of a plurality of circles each having a diameter of about 152 μm. The light shielding portion 3A is made of chromium (Cr), for example, and the circles constituting the light shielding portion 3A are formed on the photomask 3 at predetermined intervals, e.g., at intervals of 680 μm. An ultraviolet light 4 radiates the photomask 3 from the upper side thereof, so that the photoresist 2 is exposed to the ultraviolet light 4 through the light transmitting portion of the photomask 3. The photoresist 2 exposed to the ultraviolet light 4 becomes ketene, and the ketene reacts with water in the air to become indene carboxylic acid. The indene carboxylic acid has an alkali soluble characteristic. On the other hand, a portion of the photoresist 2 located just below the light shielding portion 3A of the photomask 3 is not exposed to the ultraviolet light 4. Thus, this portion of the photoresist 2 remains naphtho-quinone-diazide (FIG. 5A).

Secondly, the conductive substrate 1 from which the photomask 3 has been removed is dipped into a developer liquid such as an alkaline solution, e.g., an aqueous solution of sodium hydroxide (NaOH). That is, as the photoresist 2 exposed to the ultraviolet light 4 in the above step has become indene carboxylic acid which has an alkali soluble characteristic, the photoresist 2 is dissolved in the aqueous solution of sodium hydroxide. As a result, a plurality of columnar photoresist portions each having a diameter of 152 μm and a height of 1 μm are formed on the conductive substrate 1 at intervals of 680 μm. Thereafter, in order to remove moisture from the conductive substrate 1, the substrate 1 is placed in a clean oven and is baked in the clean oven at about 130° C. for about 30 minutes, thereby improving an adhesion strength between the columnar photoresist portions and the conductive substrate 1 to some extent and solidifying the photoresist portions themselves. Accordingly, the columnar photoresist portions formed on the conductive substrate 1 are more stabilized and secured. In this manner, only the portion of the photoresist 2 not exposed to the ultraviolet light 4 is left on the conductive substrate 1 as a photoresist pattern 2A corresponding to the pattern of the light shielding portion 3A of the photomask 3. Thus, the photoresist pattern 2A is formed on the conductive substrate 1 to prepare a master (FIG. 5B).

A releasing film 5 is then formed on the master. The releasing film 5 is a high-molecular film mainly composed of a thiazole compound (the tradename, NIKKANON TACK manufactured by NIHON KAGAKU SANGYO CO., LTD.). Thereafter, an electroformed film 6 is electrodeposited by a necessary amount on the releasing film 5 by an electroforming method. The electroforming method is carried out in the following manner, for example. First, a nickel electrode and the master with the releasing film 5 thereon are dipped into an electroforming liquid such as nickel sulfamate. A current is then applied between the nickel electrode as an anode and the master as a cathode. As a result, the electroformed film 6 of nickel is electrodeposited on the master. At this time, a thickness and quantity of the electroformed film 6 may be changed by changing a current duty period or a total current quantity (FIG. 5C).

Finally, the electroformed film 6 is separated from the conductive substrate 1, thereby resulting in a manufactured orifice plate 7 (FIG. 5D).

However, in the conventional manufacturing method for the orifice plate as described above, the adhesion strength between the photoresist pattern 2A and the substrate 1 is not very large, and furthermore, the photoresist pattern 2A itself is not very hard. For these reasons, the following problems occur. That is, in releasing the electroformed film 6 from the conductive substrate 1 in the last step, there is a possibility that the photoresist pattern 2A partially sticks to the electroformed film 6 and is separated together with the electroformed film 6 from the conductive substrate 1. Accordingly, the photoresist pattern 2A on the conductive substrate 1 is damaged. The conductive substrate 1 with the damaged photoresist pattern 2A cannot be reused as the master for the manufacturing of the orifice plate. If the conductive substrate 1 with the damaged photoresist pattern 2A is intended to be reused, the whole of the photoresist pattern 2A must be removed from the conductive substrate 1 and a new master must be prepared by performing the above steps again, which results in an increase in manufacturing cost.

Even if the above problem does not occur, another problem occurs as will be described below. That is, in the course of repeated manufacturing of the orifice plate with the use of the master, the conductive substrate 1 itself is contaminated. Accordingly, the contaminated conductive substrate 1 must be washed. In washing the conductive substrate 1, an organic solvent such as an alkaline aqueous solution having a strong detergent is preferably used. However, since the photoresist pattern 2A is soluble in the alkaline aqueous solution, the alkaline aqueous solution cannot be used for the washing of the conductive substrate 1. Accordingly, the contamination of the conductive substrate 1 cannot be sufficiently eliminated, so that a quality of the orifice plate to be manufactured by repeatedly using the same master is reduced. As a result, the number of times of usage of the master is limited, causing an increase in manufacturing cost of the orifice plate.

SUMMARY OF THE INVENTION

An object of the present invention is to provide a manufacturing method for an orifice plate which provides a high quality orifice plate and which is low in manufacturing cost.

To achieve this object, the manufacturing method for the orifice plate according to the present invention comprises the steps of preparing a master having a predetermined pattern securely provided on a substrate, depositing an electroformed film on the master by an electroforming method, and separating the electroformed film from the master.

According to the manufacturing method of the orifice plate mentioned above, a master having a predetermined pattern securely provided on a substrate is first provided. Then, an electroformed film is formed on the master by an electroforming method. Finally, the electroformed film is separated from the master. In this case, the mask pattern is securely provided on the substrate, and a mechanical strength of the mask pattern itself is large. Furthermore, the mask pattern is insoluble to an alkali aqueous solution. The master can thus be reused, and it can be strongly washed. Accordingly, the master has a durability to repeated usage, thereby contributing to an improvement in quality of the orifice plate to be manufactured and a reduction in manufacturing cost.

BRIEF DESCRIPTION OF THE DRAWINGS

A preferred embodiment of the present invention will be described in detail with reference to the following figures, wherein.

DETAILED DESCRIPTION OF THE PREFERRED EMBODIMENTS

Some preferred embodiments according to the present invention will now be described with reference to the drawings.

Figure 1:
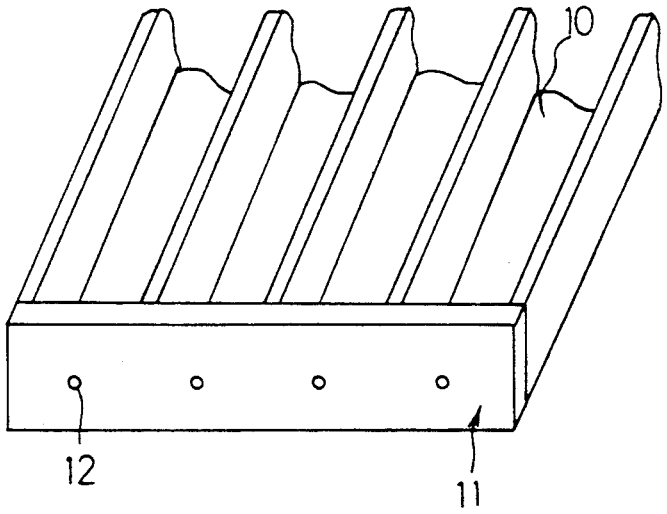
FIG. 1 is a perspective view illustrating an ink discharging portion of an ink jet printer.

FIG. 1 is a perspective view of an ink discharging portion of an ink jet printer.

As shown in FIG. 1, plural ink chambers 10 have side walls on the same side of each of the ink chambers 10 for accommodating ink therein, the side walls being defined by an orifice plate 11. The ink chambers 10 are covered by a cover plate (not shown). The orifice plate 11 is provided with a plurality of orifices 12, and each orifice 12 is formed in one-to-one corresponding relationship to each ink chamber 10. Discharge of the ink is effected by applying a positive pressure to the ink accommodated in the ink chambers 10 by a known piezoelectric method, heating method, bubble method, etc., thereby forcing the ink from the orifices 12 of the orifice plate That is, the ink is discharged from the orifices 12 of the orifice plate 11 according to an external signal, whereby desired printing is carried out by the ink jet printer.

There will now be described a manufacturing method of the orifice plate 11 in a first preferred embodiment according to the present invention with reference to FIGS. 2A to 2G in order of time.

Figure 2A:
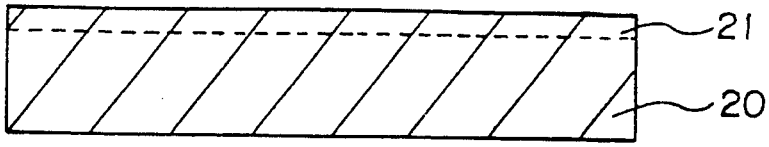
FIGS. 2A to 2G are sectional views illustrating a manufacturing method of an orifice plate in chronological order in a first preferred embodiment according to the present invention.

First, a step of forming a reforming layer is carried out as shown in FIG. 2A. In this preferred embodiment, a conductive substrate (which will be hereinafter referred to as a substrate) 20 is made of a silicon (Si) wafer. This silicon wafer has a good conductive characteristic (specific resistance: about $10^{-3}$ Ω·cm). In carrying out the step of forming the reforming layer, the substrate 20 is first covered with a covering member (not shown) so that only a surface of the substrate 20 to be transformed into the reforming layer is exposed. Then, the substrate 20 is placed in an electric furnace (not shown) and is heated at approximately 1000°–1200° C. for approximately 100 minutes. At this time, distilled water steam is introduced into the electric furnace, and the substrate 20 is heated in the atmosphere of the distilled water steam. As a result, a portion of the substrate 20 to the depth of about 1 μm from the exposed surface thereof is oxidized. This oxidized portion of the substrate 20 is a silicon dioxide ($SiO_2$) layer 21 having a nonconductive characteristic (specific resistance: about $10^{14}$Ω·cm). Thus, in substance, the silicon dioxide layer 21 having a nonconductive characteristic with a thickness of about 1 μm is integrally formed on the substrate 20 having a conductive characteristic. Furthermore, it is an important point in this step that the substrate 20 to be used must be a substrate integrally formed with a reforming layer inferior in conductive characteristic to the substrate 20 with an order of the specific resistance more than three, and that any substrates satisfying this condition may be used. The specific resistance of the reforming layer is preferably $10^3$ Ω·cm or more.

Figure 2B:
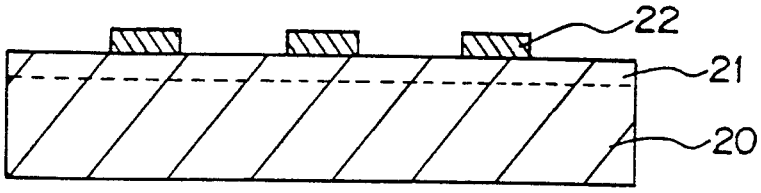

Secondly, a step of forming a photoresist pattern is carried out as shown in FIG. 2B. The covering member is first removed from the substrate 20 after removal from the electric furnace. Then, a photoresist 22 of a positive type is uniformly applied onto the silicon dioxide layer 21 of the substrate 20 by a spin coating method. The positive type photoresist 22 is naphtho-quinone-diazide as mentioned previously, and it has an alkali insoluble characteristic. After dropping 2–3 cc of the naphtho-quinone-diazide onto the substrate 20, the substrate 20 is retained by a spin coater and is rotated at 5000 rpm for approximately 20 seconds. As a result, the photoresist 22 is uniformly applied onto the substrate 20. Thereafter, the substrate 20 on which the photoresist 22 has been applied is prebaked at approximately 90° C. for 30 minutes in a clean oven (not shown). As a result, the positive type photoresist 22 having a thickness of about 1 μm is formed on the substrate 20. Thereafter, a photomask (not shown) having a light shielding portion with a predetermined pattern is placed on an upper surface of the photoresist 22. The photomask is a thin sheet or a thin plate having a characteristic of transmitting at least ultraviolet light, so that the light is permitted to penetrate only a light transmitting portion of the photomask, not the light shielding portion. The light shielding portion in this case is comprised of a plurality of circles each having a diameter of about 152 μm. The light shielding portion is made of chromium, for example, and the circles comprising the light shielding portion are formed in line on the photomask at predetermined intervals, e.g., at intervals of 680 μm. The ultraviolet light radiates the photomask from the upper side thereof, so that the photoresist 22 is exposed to the ultraviolet light through the photomask. The photoresist 22 exposed to the ultraviolet light becomes ketene, and the ketene reacts with water in the air to become indene carboxylic acid. The indene carboxylic acid has an alkali soluble characteristic. On the other hand, the photoresist 22 existing just under the light shielding portion of the photomask is not exposed to the light, and it therefore remains naphtho-quinone-diazide. Then, the photomask is removed from the photoresist 22, and the substrate 20 on which the photoresist 22 is formed is dipped into a developer such as an alkaline aqueous solution of sodium hydroxide (NaOH). As a result, the photoresist 22 exposed to the ultraviolet light, that is, the portion of the photoresist 22 formed into indene carboxylic acid is dissolved in the developer. Thereafter, in order to remove moisture from the substrate 20, the substrate 20 is baked again at approximately 130° C. for approximately 30 minutes in the clean oven, thereby further stabilizing the columnar photoresist 22 formed on the substrate 20. In this manner, only the ultraviolet light unexposed portion of the photoresist 22 uniformly applied on the substrate 20 remains on the substrate 20 as the photoresist 22 having a pattern corresponding to the pattern of the light shielding portion of the photomask.

Figure 2C:
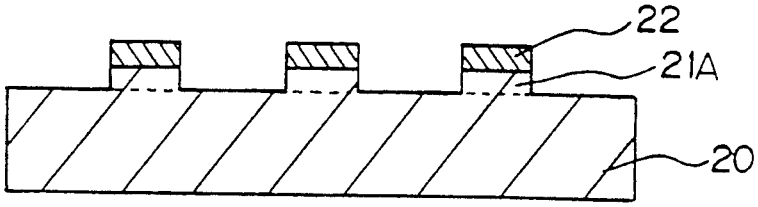

Next, an etching step is carried out as shown in FIG. 2C. The substrate 20 having the photoresist 22 with a predetermined pattern formed on the silicon dioxide layer 21 is placed in a dry etching device (not shown). By using an etching gas as a mixture gas comprising carbon tetrafluoride ($CF_4$) gas and oxygen ($O_2$), an exposed portion of the silicon dioxide layer 21 on which the photoresist 22 is not formed is etched. The oxygen in this case acts like a catalyst, and the silicon dioxide is changed into silicon tetrafluoride ($SiF_4$) and oxygen to be removed. The etching of the silicon dioxide layer 21 is carried out until the silicon layer of the substrate 20 is exposed.

Figure 2D:
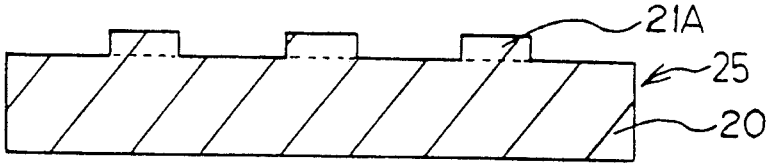

Next, a step of removing the photoresist 22 is carried out as shown in FIG. 2D. The internal gas in the dry etching device is replaced by oxygen under the condition where the substrate 20 from which the exposed silicon dioxide layer 21 has been etched off is kept in the dry etching device. As a result, the photoresist 22 reacts with the oxygen, is changed into carbon dioxide ($CO_2$) and water ($H_2O$) and is removed. Accordingly, a silicon dioxide pattern 21A having a nonconductive characteristic is integrally formed on the substrate 20 having a good conductive characteristic to prepare a master 25.

Figure 2E:
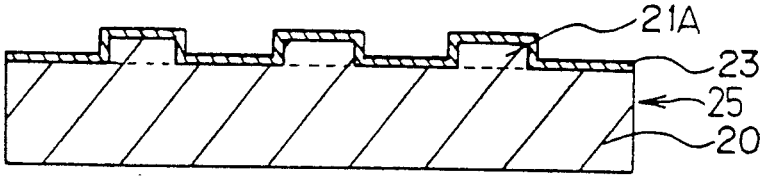

Next, a step of forming a releasing film is carried out as shown in FIG. 2E. That is, in this step, a releasing film 23 is provided on the master 25. For example, the releasing film 23 can be a high-molecular film mainly composed of a thiazole compound (the tradename, NIKKANON TACK manufactured by NIHON KAGAKU SANGYO CO., LTD.). The surface of the master 25 on which the silicon dioxide pattern 21A is formed is dipped in a solution of the NIKKANON TACK for approximately 2 minutes, and the master 25 is then washed with water. As a result, the releasing film 23 is uniformly formed on the surface of the master 25 on which the silicon dioxide pattern 21A is formed.

Figure 2F:
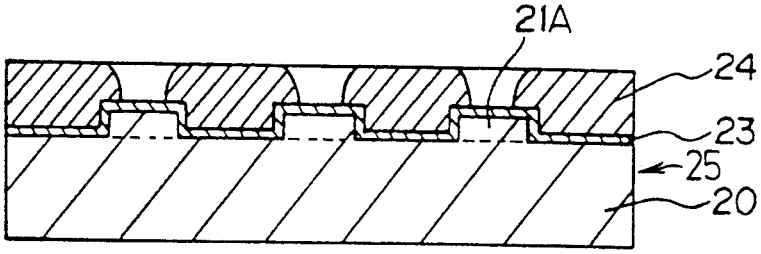

Next, an electrode position step by an electroforming method is carried out as shown in FIG. 2F. The master 25 on which the releasing film 23 is formed and a nickel electrode (not shown) are dipped into an electroforming liquid containing nickel sulfamate, nickel chloride, boric acid, pit preventing agent and brightener. A current is then applied between the nickel electrode as an anode and the master 25 as a cathode. As a result, an electroformed film 24 made of nickel is electrodeposited onto the master 25. The electroformed film 24 is electrodeposited on only a portion of the master 25 having a conductive characteristic, that is, on a portion of the master 25 excluding the silicon dioxide pattern 21A. As the electrode position proceeds, the electroformed film 24 is progressively formed also over the silicon dioxide pattern 21A as shown in FIG. 2F. When the thickness of the electroformed film 24 reaches about 50 μm, the current is cut off to stop the electrode position. At this time, the thickness or the quantity of the electroformed film 24 may be changed by changing a current duty period or a total current quantity.

Figure 2G:
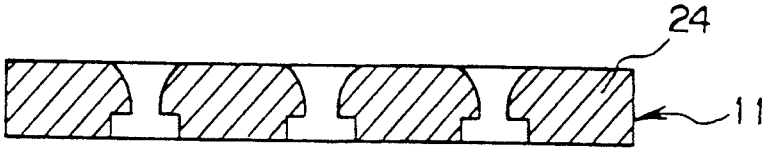

Finally, a step of releasing and finishing the electroformed film 24 is carried out as shown in FIG. 2G. That is, the electroformed film 24 is released from the master 25, and the electroformed film 24 thus released becomes the orifice plate 11. As the releasing film 23 is uniformly formed on the master 25, the electroformed film 24 can be easily released from the master 25. Furthermore, as the substrate 20 made of a silicon wafer and the silicon dioxide pattern 21A as a mask pattern are formed integrally with each other, an original form of the substrate 20 and the silicon dioxide pattern 21A (i.e., the master 25 shown in FIG. 2D) can be maintained when the electroformed film 24 is released from the master 25. Accordingly, the master 25 can be used many times for the manufacturing of the orifice plate, thereby reducing a manufacturing cost. However, there is a possibility that the releasing film 23 is partially damaged when the electroformed film 24 is released from the master 25. In this case, in carrying out the electrodeposition step again, the releasing film 23 left on the master 25 is completely removed, and then, the releasing film 23 is newly formed on the master 25. Thereafter, the successive step is similarly carried out to manufacture the next orifice plate 11.

Having thus described the manufacturing steps of the orifice plate in the first preferred embodiment, there is a possibility that the substrate 20 and the silicon dioxide pattern 21A are contaminated in the course of repeated usage of the master 25. In this case, the master 25 is electrolytically washed in an alkali aqueous solution having a strong detergent. This is due to the fact that the silicon dioxide pattern 21A of the master 25 is formed integrally with the substrate 20. Accordingly, it has a large mechanical strength and superior resisting properties to an organic solvent and an alkali solution. Thus, even when the master 25 is contaminated, it can be strongly washed, so that the qualitative stability of the orifice plate 11 can be ensured.

There will now be described a manufacturing method for an orifice plate 13 in a second preferred embodiment according to the present invention with reference to FIGS. 3A to 3G. In this preferred embodiment, a stainless steel plate is employed as a conductive substrate (which will be hereinafter referred to as a substrate) 30.

Figure 3A:
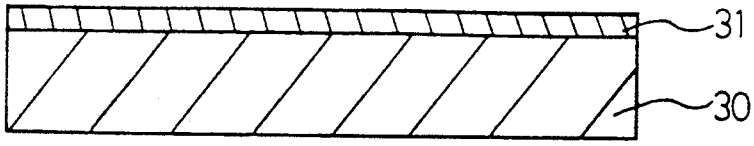
FIGS. 3A to 3G are sectional views illustrating a manufacturing method of an orifice plate in chronological order in a second preferred embodiment according to the present invention.

First, a step of depositing oxide 31 on the substrate 30 is carried out as shown in FIG. 3A. That is, the oxide 31 such as silicon dioxide is deposited on the substrate 30 by a known method such as a vacuum film forming method (e.g., a sputtering method or an ion plating method) or a sol-gel method. This step may be carried out by any of the above methods. The oxide 31 thus formed is very strongly deposited on the substrate 30. In this preferred embodiment, a case is illustrated wherein silicon dioxide is deposited onto the substrate 30 by the sol-gel method by way of example. This method as well as the other methods mentioned above is known, so that it will not be described in detail.

In this step, after dropping 2–3 cc of coating liquid for forming a silicon dioxide film (the tradename, OCD manufactured by TOKYO OHKA KOGYO CO., LTD.) onto the substrate 30, the substrate 30 is retained by a spin coater and is rotated at 5000 rpm for approximately 20 seconds. As a result, the coating liquid is uniformly applied on the substrate 30. The substrate 30 on which the coating liquid has been applied is then baked at approximately 700° ∝ 1100° C. for approximately 1 hour in a clean oven. As a result, a silicon dioxide layer as the oxide 31 having a thickness of about 1 μm is formed on the substrate 30.

Figure 3B:
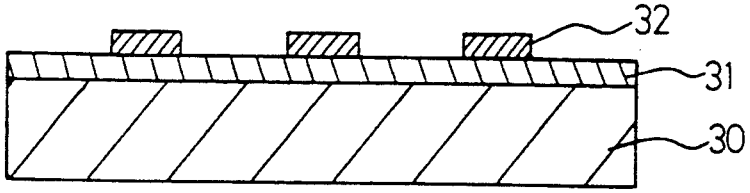

Secondly, a step of forming a photoresist pattern is carried out as shown in FIG. 3B. First, a photoresist 32 of a positive type is uniformly applied onto the silicon dioxide layer 31 of the substrate 30 by a spin coating method. The positive type photoresist 32 is naphtho-quinone-diazide as mentioned previously, and it has an alkali insoluble characteristic. After dropping 2–3 cc of the naphtho-quinone-diazide onto the substrate 30, the substrate 30 is retained by a spin coater and is rotated at 5000 rpm for approximately 20 seconds. As a result, the photoresist 32 is uniformly applied onto the substrate 30. Thereafter, the substrate 30 on which the photoresist 32 has been applied is prebaked at approximately 90° C. for approximately 30 minutes in a clean oven (not shown). As a result, the positive type photoresist 32 having a thickness of about 1 μm is formed on the substrate 30. Thereafter, a photomask (not shown) having a light shielding portion with a predetermined pattern is placed on an upper surface of the photoresist 32. The photomask is a thin sheet or a thin plate having a characteristic of transmitting at least ultraviolet light, so that the light is permitted to penetrate only a light transmitting portion of the photomask, not the light shielding portion. The light shielding portion in this case comprises a plurality of circles each having a diameter of about 152 μm. The light shielding portion is made of chromium, for example, and the circles comprising the light shielding portion are formed in line on the photomask at predetermined intervals, e.g., at intervals of 680 μm. The ultraviolet light radiates the photomask from the upper side thereof, so that the photoresist 32 is exposed to the ultraviolet light through the photomask. The photoresist 32 exposed to the ultraviolet light becomes ketene, and the ketene reacts with water in the air to become indene carboxylic acid. The indene carboxylic acid has an alkali soluble characteristic. On the other hand, the photoresist 32 existing just under the light shielding portion of the photomask is not exposed to the light, and it therefore remains naphtho-quinone-diazide. Then, the photomask is removed from the photoresist 32, and the substrate 30 on which the photoresist 32 is formed is dipped into a developer as an alkaline aqueous solution of sodium hydroxide (NaOH). As a result, the photoresist 32 exposed to the ultraviolet light, that is, the portion of the photoresist 32 formed into indene carboxylic acid is dissolved into the developer. Thereafter, in order to remove moisture from the substrate 30, the substrate 30 is baked again at approximately 130° C. for approximately 30 minutes in the clean oven, thereby further stabilizing the columnar photoresist 32 formed on the substrate 30. In this manner, only the ultraviolet light unexposed portion of the photoresist 32 uniformly applied on the substrate 30 is left on the substrate 30 as the photoresist 32 having a pattern corresponding to the pattern of the light shielding portion of the photomask.

Figure 3C:
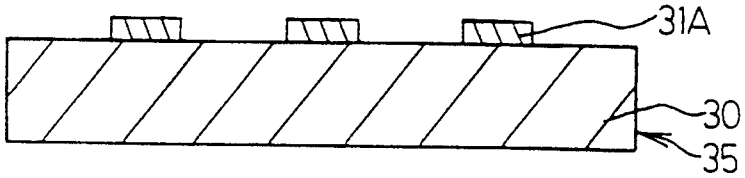

Next, an etching step is carried out as shown in FIG. 3C. The substrate 30 having the photoresist 32 with a predetermined pattern formed on the silicon dioxide layer 31 is placed in a dry etching device (not shown). By using etching gas as mixture gas comprising carbon tetrafluoride ($CF_4$) gas and oxygen ($O_2$), an exposed portion of the silicon dioxide layer 31 on which the photoresist 32 is not formed is etched. The oxygen in this case acts like a catalyst, and the silicon dioxide is changed into silicon tetrafluoride ($SiF_4$) and oxygen to be removed. The etching of the silicon dioxide layer 31 is carried out until the silicon layer of the substrate 30 is exposed. The internal gas in the dry etching device is replaced by oxygen under the condition where the substrate 30 from which the exposed silicon dioxide layer 31 has been etched off is kept in the dry etching device. As a result, the photoresist 32 reacts with the oxygen, is changed into carbon dioxide ($CO_2$) and water ($H_2O$) and is removed. Accordingly, a silicon dioxide pattern 31A having a nonconductive characteristic is strongly deposited on the substrate 30 having a good conductive characteristic to prepare a master 35. The master 35 is baked at approximately 500° C. for approximately 1 hour in a vacuum baking furnace. As a result, the silicon dioxide pattern 31A is improved in its insulating property, and it is solidified to be stabilized.

Figure 3D:
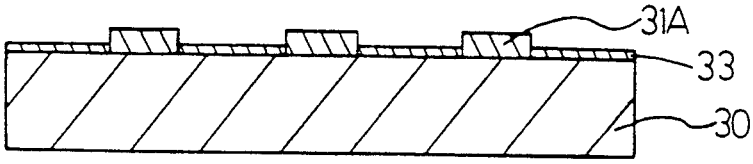
Figure 3E:
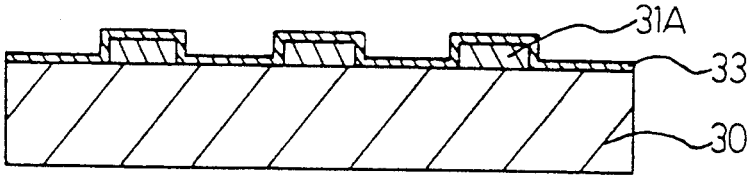

Next, a step of forming a releasing film is carried out as shown in FIGS. 3D and 3E. That is, in this step, a releasing film 33 is formed on the master 35. In case of forming the releasing film 33 by an anodic oxidation method in an alkali solution, for example, the releasing film 33 is formed on the stainless steel exposed portion only of the substrate 30, that is, only on the conductor exposed portion of the substrate 30. Further, in case of employing a high-molecular film mainly composed of a thiazole compound (the tradename, NIKKANON TACK manufactured by NIHON KAGAKU SANGYO CO., LTD.), for example, as the releasing film 33, the releasing film 33 is formed on the entire surface of the master 35 on which the silicon dioxide pattern 31A is formed. In this case, the surface of the master 35 on which the silicon dioxide pattern 31A is formed is dipped in a solution of the NIKKANON TACK for approximately 2 minutes, and then, the master 35 is washed with water. As a result, the releasing film 33 is uniformly formed on the surface of the master 35 on which the silicon dioxide pattern 31A is formed.

Figure 3F:
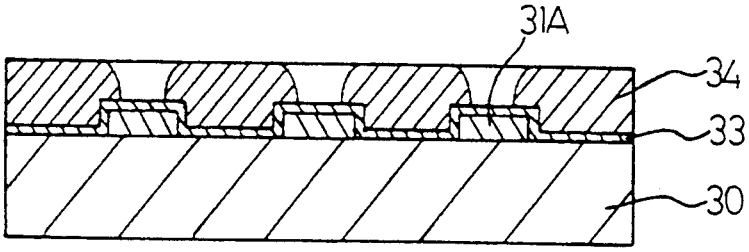

Next, an electrodeposition step by an electroforming method is carried out as shown in FIG. 3F. The master 35 on which the releasing film 33 is formed and a nickel electrode (not shown) are dipped into electroforming liquid containing nickel sulfamate, nickel chloride, boric acid, pit preventing agent and brightener. A current is then applied between the nickel electrode as an anode and the master 35 as a cathode. As a result, an electroformed film 34 made of nickel is electrodeposited onto the master 35. The electroformed film 34 is electrodeposited on only a portion of the master 35 having a conductive characteristic, that is, on a portion of the master 35 excluding the silicon dioxide pattern 31A. As the electrodeposition proceeds, the electroformed film 34 is progressively formed also over the silicon dioxide pattern 31A as shown in FIG. 3F. When the thickness of the electroformed film 34 reaches about 50 μm, the current is cut off to stop the electrodeposition. At this time, the thickness or quantity of the electroformed film 34 may be changed by changing a current duty period or a total current quantity.

Figure 3G:
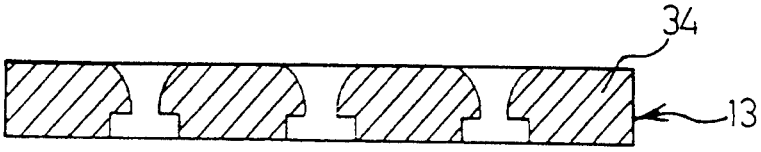

Finally, a step of releasing and finishing the electroformed film 34 is carried out as shown in FIG. 3G. That is, the electroformed film 34 is released from the master 35, and the electroformed film 34 thus released becomes the orifice plate 13. As the releasing film 33 is uniformly formed on the master 35 or formed on the stainless steel layer only of the master 35, the electroformed film 34 can be easily released from the master 35. Further, as the silicon dioxide pattern 31A as a mask pattern is very strongly deposited on the substrate 30 made of a stainless steel plate, an original form of the substrate 30 and the silicon dioxide pattern 31A (i.e., the master 35 shown in FIG. 3C) can both be maintained in releasing the electroformed film 34 from the master 35. Accordingly, the master 35 can be used many times for the manufacturing of the orifice plate, thereby reducing a manufacturing cost. However, there is a possibility that the releasing film 33 is partially damaged in releasing the electroformed film 34 from the master 35. In this case, in carrying out the electrodeposition step again, the releasing film 33 left on the master 35 is completely removed, and then, the releasing film 33 is newly formed on the master 35. Thereafter, the successive step is similarly carried out to manufacture the next orifice plate 13.

Having thus described the manufacturing steps of the orifice plate in the second preferred embodiment, there is a possibility that the substrate 30 and the silicon dioxide pattern 31A are contaminated in the course of repeated usage of the master 35. In this case, the master 35 is electrolytically washed in an alkali aqueous solution having a strong detergent. This is due to the fact that the silicon dioxide pattern 31A of the master 35 is strongly deposited on the substrate 30, and that it has a large mechanical strength and superior resisting properties to an organic solvent and an alkali solution. Accordingly, even when the master 35 is contaminated, it can be strongly washed, so that the qualitative stability of the orifice plate 13 can be ensured.

There will now be described a manufacturing method for an orifice plate 14 in a third preferred embodiment according to the present invention with reference to FIGS. 4A to 4F. In this preferred embodiment, unlike the first and second preferred embodiments, a substrate having a nonconductive characteristic, such as a glass substrate (which will be hereinafter referred to as a substrate) 40 is employed.

Figure 4A:
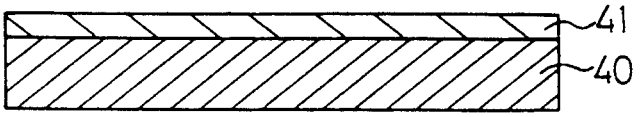
FIGS. 4A to 4F are sectional views illustrating a conventional manufacturing method of an orifice plate in chronological order in a third preferred embodiment according to the present invention.

First, a step of depositing a metal chromium film 41 having a conductive characteristic on the substrate 40 is carried out as shown in FIG. 4A. That is, the metal film 41 such as a chromium film is deposited on the substrate 40 by a known method such as a vacuum film forming method (e.g., a sputtering method or an ion plating method). This step may be carried out by any method of the above. The chromium film 41 thus formed is very strongly deposited on the substrate 40. Each of the above-mentioned methods is known, so that it will not be described in detail.

Figure 4B:
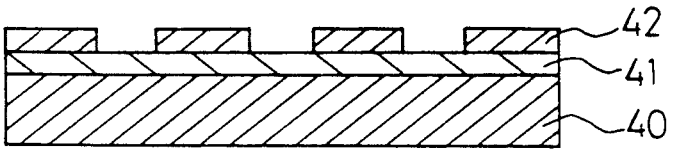

Secondly, a step of forming a photoresist pattern is carried out as shown in FIG. 4B. First, a photoresist 42 of a positive type is uniformly applied onto the chromium film 41 of the substrate 40 by a spin coating method. The positive type photoresist 42 is naphtho-quinone-diazide as mentioned previously, and it has an alkali insoluble characteristic. After dropping 2–3 cc of the naphtho-quinone-diazide onto the chromium film 41 of the substrate 40, the substrate 40 is retained by a spin coater and is rotated at 5000 rpm for approximately 20 seconds. As a result, the photoresist 42 is uniformly coated on the substrate 40. Thereafter, the substrate 40 on which the photoresist 42 has been applied is prebaked at approximately 90° C. for approximately 30 minutes in a clean oven (not shown). As a result, the positive type photoresist 42 having a thickness of about 1μm is formed on the substrate 40. Thereafter, a photomask (not shown) having a light shielding portion with a predetermined pattern is placed on an upper surface of the photoresist 42. The photomask is a thin sheet or a thin plate having a characteristic of transmitting at least ultraviolet light, so that the light is permitted to penetrate only a light transmitting portion of the photomask, not the light shielding portion. The light transmitting portion in this case comprises a plurality of circles each having a diameter of about 152 μm. The light transmitting portion is made of chromium, for example, and the circles comprising the light transmitting portion are formed in line on the photomask at predetermined intervals, e.g., at intervals of 680 μm.

The ultraviolet light radiates the photomask from the upper side thereof, so that the photoresist 42 is exposed to the ultraviolet light through the photomask. The photoresist 42 exposed to the ultraviolet light becomes ketene, and the ketene reacts with water in the air to become indene carboxylic acid. The indene carboxylic acid has an alkali soluble characteristic. On the other hand, the photoresist 42 existing just under the light shielding portion of the photomask is not exposed to the light, and it therefore remains naphtho-quinone-diazide. The photomask is then removed from the photoresist 42, and the substrate 40 on which the photoresist 42 is formed is dipped into a developer as an alkaline aqueous solution of sodium hydroxide (NaOH). As a result, the photoresist 42 exposed to the ultraviolet light, that is, the portion of the photoresist 42 formed into indene carboxylic acid is dissolved into the developer. Thereafter, in order to remove moisture from the substrate 40, the substrate 40 is baked again at approximately 130° C. for approximately 30 minutes in the clean oven, thereby further stabilizing the photoresist 42 formed on the substrate 40. In this manner, only the ultraviolet light unexposed portion of the photoresist 42 uniformly applied on the substrate 40 is left on the substrate 40 as the photoresist 42 having a pattern corresponding to the pattern of the light shielding portion of the photomask.

Figure 4C:
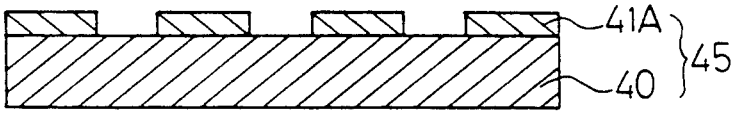

Next, an etching step is carried out as shown in FIG. 4C. An exposed portion of the chromium film 41 of the substrate 40 having the photoresist 42 with a predetermined pattern formed on the chromium film 41 is etched by a wet etching method until the glass layer of the substrate 40 is exposed. That is, by using a mixture solution of secondary cerium ammonium and hydrogen peroxide aqueous solution, the exposed portion of the chromium film 41 is etched. Thereafter, the photoresist 42 formed on an unexposed portion of the chromium film 41 is dissolved in an organic solvent to be removed. As a result, a chromium film pattern 41A having a good conductive characteristic is strongly deposited on the substrate 40 having a nonconductive characteristic to prepare a master 45.

Figure 4D:
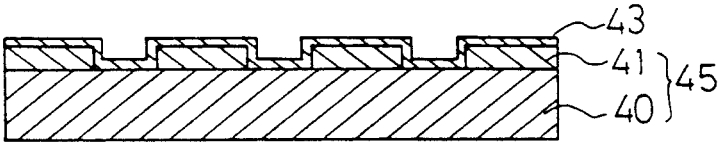

Next, a step of forming a releasing film is carried out as shown in FIG. 4D. That is, in this step, a releasing film 43 is formed on the master 45. For example, the releasing film 43 is a high-molecular film mainly composed of a thiazole compound (the tradename, NIKKANON TACK manufactured by NIHON KAGAKU SANGYO CO., LTD.). The surface of the master 45 on which the chromium film pattern 41A is formed is dipped in a solution of the NIKKANON TACK for approximately 2 minutes, and then, the master 45 is washed with water. As a result, the releasing film 43 is uniformly formed on the surface of the master 45 on which the chromium film pattern 41A is formed.

Figure 4E:
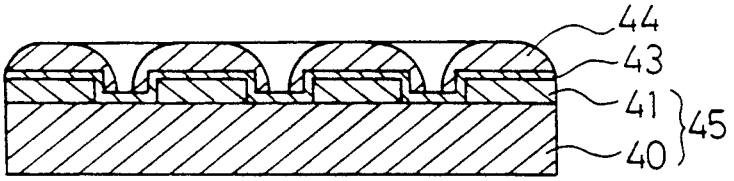

Next, an electrodeposition step by an electroforming method is carried out as shown in FIG. 4E. The master 45 on which the releasing film 43 is formed and a nickel electrode (not shown) are dipped into electroforming liquid containing nickel sulfamate, nickel chloride, boric acid, pit preventing agent and brightener. A current is then applied between the nickel electrode as an anode and the master 45 as a cathode. As a result, an electroformed film 44 made of nickel is electrodeposited on the master 45. The electroformed film 44 is electrodeposited on only a portion of the master 45 having a conductive characteristic, that is, on the chromium film pattern 41A of the master 45. A the electrodeposition proceeds, the electroformed film 44 is progressively formed also over the exposed glass layer of the substrate 40 as shown in FIG. 4E. When the thickness of the electroformed film 44 reaches about 50 μm, the current is cut off to stop the electrodeposition. At this time, the thickness or quantity of the electroformed film 44 may be changed by changing a current duty period or a total current quantity.

Figure 4F:
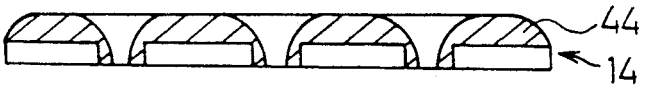
Figure 5A:
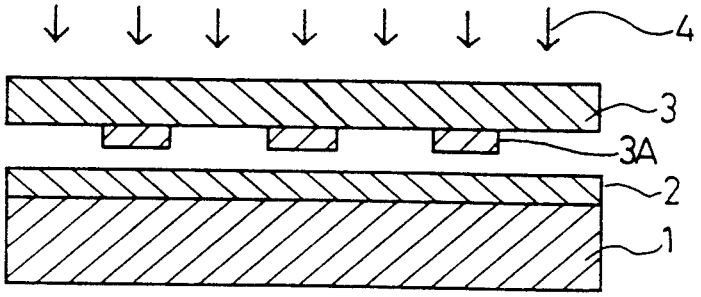
Fig.5A RELATED ART
FIGS. 5A to 5D are sectional views illustrating a conventional manufacturing method of an orifice plate in chronological order.
Figure 5B:
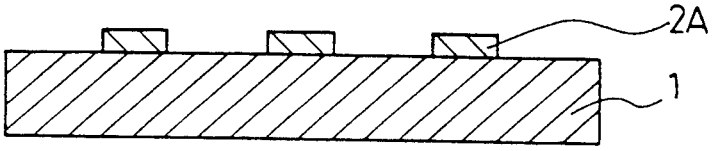
Fig.5B RELATED ART
Figure 5C:
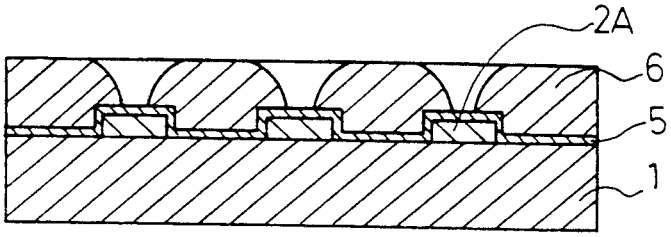
Fig.5C RELATED ART
Figure 5D:
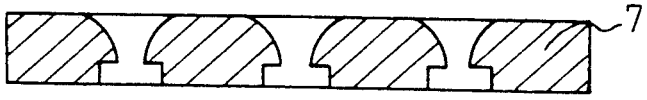
Fig.5D RELATED ART

Finally, a step of releasing and finishing the electroformed film 44 is carried out as shown in FIG. 4F. That is, the electroformed film 44 is released from the master 45, and the electroformed film 44 thus released becomes the orifice plate 14. As the releasing film 43 is uniformly formed on the master 45, the electroformed film 44 can be easily released from the master 45. Furthermore, as the chromium film pattern 41A as a mask pattern is very strongly deposited on the substrate 40 made of glass, an original form of the substrate 40 and the chromium film pattern 41A (i.e., the master 45 shown in FIG. 4C) can both be maintained when the electroformed film 44 is released from the master 45. Accordingly, the master 45 can be used many times for the manufacturing of the orifice plate, thereby reducing a manufacturing cost. However, there is a possibility that the releasing film 43 is partially damaged in releasing the electroformed film 44 from the master 45. In this case, in carrying out the electrodeposition step again, the releasing film 43 left on the master 45 is completely removed, and then, the releasing film 43 is newly formed on the master 45. Thereafter, the successive step is similarly carried out to manufacture the next orifice plate 14.

Having thus described the manufacturing steps of the orifice plate in the third preferred embodiment, there is a possibility that the substrate 40 and the chromium film pattern 41A are contaminated in the course of repeated usage of the master 45. In this case, the master 45 is electrolytically washed in an alkali aqueous solution having a strong detergent. This is due to the fact that the chromium film pattern 41A of the master 45 is strongly deposited on the substrate 40, and that it has a large mechanical strength and superior resisting properties to an organic solvent and an alkali solution. Accordingly, even when the master 45 is contaminated, it can be strongly washed, so that the qualitative stability of the orifice plate 14 can be ensured.

It is to be noted that the present invention is not limited to the above preferred embodiments but various modifications may be made without departing from the scope of the invention.

For instance, while the first preferred embodiment employs the substrate 20 formed from a silicon wafer having an oxide layer as a reforming layer, a low-resistance layer may be formed on a substrate formed from a high-resistance silicon wafer by diffusion of an impurity. Further, any layer having a specific resistance different from that of a substrate may be formed on the substrate by a predetermined depth from the surface thereof.

Furthermore, while the second preferred embodiment employs silicon dioxide as a nonconductive substance, any other oxides such as another silicon oxide (SiOx), magnesium oxide (MgO), aluminum oxide ($Al_2O_3$) and titanium oxide ($TiO_2$), nitrides such as aluminum nitride (AlN) and silicon nitride (SiN), or a mixture thereof, i.e., sialon (SiAlON) may be employed. Moreover, any metal compounds having a nonconductive characteristic may be employed.

Furthermore, while the second preferred embodiment employs metal such as stainless steel as the conductive substrate 30, a conductive metal such as nickel or chromium may be formed on a nonconductor such as ceramic by sputtering or the like to prepare a substrate.

Moreover, while the third preferred embodiment employs a glass plate as the substrate 40, any other substrates having a nonconductive characteristic such as a ceramic plate may be employed. Further, while the third preferred embodiment employs a chromium film as a conductive substance, any other substances having a good conductive characteristic such as tantalum may be employed.

Additionally, while the third preferred embodiment employs a wet etching method as the etching method for the conductive substrate pattern, a known dry etching method may be employed.

Furthermore, while all of the above preferred embodiments employ a nickel sulfamate bath as the electroforming liquid, any other electroforming liquids such as a copper sulfate bath may be employed.

As described above, according to the present invention, the substrate on which the mask pattern is formed can be repeatedly used, thereby improving the quality of an orifice plate and reducing the manufacturing cost.

What is claimed is:

1. A method of manufacturing an orifice plate comprising the steps of:

coating a nonconductive layer firmly on a conducive substrate;

forming a predetermined photoresist pattern on said nonconductive layer;

etching said nonconductive layer to expose said conductive substrate at any portion of said nonconductive layer on which said predetermined photoresist pattern is into provided;

removing said predetermined photoresist pattern from said nonconductive layer and integrally forming a master having a nonconductive layer pattern corresponding to said photoresist pattern;

depositing an electroformed film on said master by an electroforming method; and separating said electroformed film from said master.

2. The method of manufacturing a orifice plate according to claim 1, further comprising the step of forming a releasing film on said master before depositing said electroformed film on said master.

3. The method of manufacturing a orifice plate according to claim 1, including providing one of oxide, nitride and sialon as said predetermined pattern on said substrate.

4. The method of claim 1, wherein the substrate is stainless steel.

5. The method of claim 1, wherein the coating step is accomplished by a sol-gel method.

6. The method of claim 1, wherein the coating step is achieved by a vacuum film forming method.

7. The method of claim 1, wherein the coating step comprises the steps of:

dropping a coating liquid on the substrate;

rotating the substrate at a high speed for a predetermined rotation time; and baking the substrate at a predetermined baking temperature for a predetermined baking time to form a layer thereon.

8. The method of claim 7, wherein the rotating liquid is silicon dioxide.

9. The method of claim 7, wherein the rotating step is carried out at a speed of about 5,000 rpm.

10. The method of claim 7, wherein the predetermined rotation time is about 20 seconds.

11. The method of claim 7, wherein the predetermined baking temperature is about 700°-1100° C.

12. The method of claim 7, wherein the predetermined baking time is about 1 hour.

* * * * *